US007290602B2

(12) United States Patent
Victor

(10) Patent No.: US 7,290,602 B2
(45) Date of Patent: Nov. 6, 2007

(54) INTERNAL SHOCK ABSORBER BYPASS PLUNGER

(75) Inventor: Bruce M. Victor, Ft. Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 284 days.

(21) Appl. No.: 11/010,168

(22) Filed: Dec. 10, 2004

(65) Prior Publication Data

US 2006/0124294 A1 Jun. 15, 2006

(51) Int. Cl.
*E21B 43/00* (2006.01)

(52) U.S. Cl. ..... 166/105; 166/68

(58) Field of Classification Search ..... 166/68, 166/372

See application file for complete search history.

(56) References Cited

U.S. PATENT DOCUMENTS

| | | | | |
|---|---|---|---|---|
| 2,147,766 A | | 2/1939 | Coberly | 103/46 |
| 2,714,855 A | | 8/1955 | Brown | 103/52 |
| 3,181,470 A | | 5/1965 | Clingman | 103/52 |
| 3,806,106 A | | 4/1974 | Hamel et al. | |
| 4,198,037 A | | 4/1980 | Anderson | |
| 4,275,790 A | | 6/1981 | Abercrombie | |
| 4,475,722 A | | 10/1984 | Paton et al. | |
| 4,502,843 A | | 3/1985 | Martin | |
| 4,712,981 A | | 12/1987 | Gramling William D. | 417/56 |
| 4,833,973 A | | 5/1989 | Wang | |
| 4,962,916 A | | 10/1990 | Palinkas | |
| 4,986,727 A | * | 1/1991 | Blanton | 417/57 |
| 5,052,665 A | | 10/1991 | Sakuragi | |
| 5,253,713 A | | 10/1993 | Gregg et al. | |
| 5,280,890 A | | 1/1994 | Wydra | |
| 5,327,596 A | | 7/1994 | Wallace et al. | |
| 5,333,684 A | | 8/1994 | Walter et al. | 166/54 |
| 5,467,970 A | | 11/1995 | Ratu et al. | |
| 5,868,384 A | | 2/1999 | Anderson | |
| 5,957,441 A | | 9/1999 | Tews | |
| 6,148,923 A | | 11/2000 | Casey | 166/372 |
| 6,176,309 B1 | | 1/2001 | Bender | 166/68 |
| 6,250,617 B1 | | 6/2001 | Tews | |
| 6,273,690 B1 | | 8/2001 | Fischer, Jr. et al. | |
| 6,543,543 B2 | | 4/2003 | Muth | |
| 6,554,580 B1 | | 4/2003 | Mayfield et al. | |
| 6,568,477 B1 | | 5/2003 | Dveyrin | |
| 6,571,868 B2 | | 6/2003 | Victor | 166/70 |

(Continued)

FOREIGN PATENT DOCUMENTS

| | | |
|---|---|---|
| CA | 2 428 618 A1 | 11/2004 |
| RU | 2225502 | 3/2004 |

OTHER PUBLICATIONS

Bruce M. Victor, "Internal Shock Absorber Plunger", U.S. Appl. No. 11/009,997, filed Dec. 10, 2004, complete copy of specification, drawings, filling receipt.

(Continued)

*Primary Examiner*—Frank Tsay
(74) *Attorney, Agent, or Firm*—Aileen Law; A Law Firm, P.C.

(57) ABSTRACT

A bypass plunger having one or more internal shock absorbing elements and a variety of bypass orifice options is disclosed.

20 Claims, 9 Drawing Sheets

U.S. PATENT DOCUMENTS

| | | | | |
|---|---|---|---|---|
| 6,591,737 | B2 | 7/2003 | Giacomino | 92/193 |
| 6,637,510 | B2 | 10/2003 | Lee | |
| 6,669,449 | B2 | 12/2003 | Giacomino | 417/56 |
| 6,705,404 | B2 | 3/2004 | Bosley | 166/372 |
| 6,725,916 | B2 | 4/2004 | Gray et al. | |
| 6,746,213 | B2 | 6/2004 | Giacomino | 417/56 |
| 6,907,926 | B2 | 6/2005 | Bosley | 166/108 |
| 6,945,762 | B2 | 9/2005 | Williams | 417/546 |
| 2002/0066572 | A1 | 6/2002 | Muth | |
| 2002/0162662 | A1 | 11/2002 | Passamaneck et al. | |
| 2003/0141051 | A1 | 7/2003 | Abbott et al. | |
| 2003/0155129 | A1 | 8/2003 | Gray et al. | |
| 2003/0215337 | A1 | 11/2003 | Lee | |
| 2004/0129428 | A1 | 7/2004 | Kelley | 166/372 |
| 2006/0113072 | A1* | 6/2006 | Lee | 166/68 |

OTHER PUBLICATIONS

Bruce M. Victor, "Variable Orifice Bypass Plunger", U.S. Appl. No. 60/563,711, filed Apr. 20, 2004, complete copy of specification, drawings, filing receipt (utility application claiming priority from provisional to be filled).

Jeffrey L. Giacomino, U.S. Appl. No. 11/060,513, "Data Logger Plunger" filed Feb. 17, 2005. (No copy attached per MPEP 609.04 (a)(II)(C) because Application is stored in Image File Wrapper System.).

Bruce M. Victor, U.S. Appl. No. 11/110,447, "Variable Oritice Bypass Plunger" filed Apr. 20, 2005. (No copy attached per MPEP 609.04 (a)(II)(C) because Application is stored in Image File Wrapper System.).

Bruce M. Victor, U.S. Appl. No. 11/105,753, "Sand Plunger" filed Apr. 14, 2005. (No copy attached per MPEP 609.04 (a)(II)(C) because Application is stored in Image File Wrapper System.).

Bruce M. Victor, U.S. Appl. No. 10/803,373, "Multi-Part Plunger" filed Mar. 18, 2004. (No copy attached per MPEP 609.04 (a)(II)(C) because Application is stored in Image File Wrapper System.).

Jeffrey L. Giacomino, U.S. Appl. No. 11/071,148, "Thermal Actuated Plunger" filed Mar. 3, 2005. (No copy attached per MPEP 609.04 (a)(II)(C) because Application is stored in Image File Wrapper System.).

* cited by examiner

INTERNAL SHOCK ABSORBER BYPASS PLUNGER

FIELD OF THE INVENTION

The present invention relates to a plunger lift apparatus for the lifting of formation liquids in a hydrocarbon well. More specifically the plunger comprises an upper bypass mandrel, an internal shock absorber plunger section and a lower bypass valve. The shock absorbing bypass plunger operates to absorb shock during plunger falls to a well bottom, and high velocity rises to the well top, while providing for a bypass function during plunger travel.

BACKGROUND OF THE INVENTION

A plunger lift is an apparatus that is used to increase the productivity of oil and gas wells. In the early stages of a well's life, liquid loading is usually not a problem. When rates are high, the well liquids are carried out of the well tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As flow rate and pressures decline in a well, lifting efficiency can decline. Before long the well could begin to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed, and some of the liquid adheres to the tubing wall, creating a film of liquid on the tubing wall.

This liquid may not reach the surface. Secondly, as the flow velocity continues to slow, the gas phase may no longer support liquid in either slug form or droplet form. This liquid, along with the liquid film on the sides of the tubing, may fall back to the bottom of the well. In a very aggravated situation, there could be liquid in the bottom of the well with only a small amount of gas being produced at the surface. The produced gas must bubble through the liquid at the bottom of the well and then flow to the surface. Because of the low velocity very little liquid, if any, may be carried to the surface by the gas. A plunger lift will act to remove the accumulated liquid, thereby improving lifting efficiency.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4A. Extracting rod 4A may or may not be employed depending on the plunger type. It is commonly used to open bypass valves and can be spring loaded. Contained within lubricator assembly 10 is plunger auto catching device 5 and plunger sensing device 6. Sensing device 6 sends a signal to surface controller 15 upon plunger 200A arrival at the well top. Plunger 200A can represent the plunger of the present invention or other prior art plungers. Sensing the plunger is used as a programming input to achieve the desired well production, flow times and wellhead operating pressures. Master valve 7 should be sized correctly for the tubing 9 and plunger 200A. An incorrectly sized master valve 7 will not allow plunger 200A to pass through. Master valve 7 should incorporate a full bore opening equal to the tubing 9 size. An oversized valve will allow gas to bypass the plunger causing it to stall in the valve. If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system. Fluid accumulating on top of plunger 200A may be carried to the well top by plunger 200A.

Surface control equipment usually consists of motor valve(s) 14, sensors 6, pressure recorders 16, etc., and an electronic controller 15 which opens and closes the well at the surface. Well flow 'F'proceeds downstream when surface controller 15 opens well head flow valves. Controllers operate on time, or pressure, to open or close the surface valves based on operator-determined requirements for production. Modem electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

FIGS. 2, 2A, 2B and 2C are side views of typical mandrel sections. Various existing sidewall geometries (known in prior art) can be used in conjunction with the present apparatus. In each of FIGS. 2-2C, an upper section of the plunger embodiment comprises a top collar shown with an internal standard American Petroleum Institute (API) fishing neck design A. If retrieval is required, a spring-loaded ball within a retriever and protruding outside its surface would thus fall within the API internal fishing neck at the top of the mandrel orifice to a point wherein the inside diameter of the orifice would increase to allow the ball to spring outward. This condition would allow retrieving of the plunger if, and when, necessary. Modification of each mandrel's lower section will be described below. Internal orifice 18 permits fluid to flow through each mandrel section shown as the plunger travels toward the well bottom bumper spring. A bypass valve (not shown) attaches via lower threads 19A and shuts off (closes) when the plunger reaches the bottom. The bypass feature optimizes plunger travel time in high liquid wells.

A. Plunger mandrel 20 is shown with solid ring 22 sidewall geometry. Solid sidewall rings 22 can be made of various materials such as steel, poly materials, Teflon®, stainless steel, etc. Inner cut grooves 30 allow sidewall debris to accumulate when a plunger is rising or falling.

B. Mandrel 80 is shown with shifting ring 81 sidewall geometry. Shifting rings 81 allow for continuous contact against the tubing to produce an effective seal with wiping action to ensure that all scale, salt or paraffin is removed from the tubing wall. Shifting rings 81 are individually separated at each upper surface and lower surface by air gap 82.

C. Plunger mandrel 60 has spring-loaded interlocking pads 61 in one or more sections. Interlocking pads 61 expand and contract to compensate for any irregularities in the tubing, thus creating a tight friction seal.

D. Plunger mandrel 70 incorporates a spiral-wound, flexible nylon brush 71 surface to create a seal and allow the plunger to travel despite the presence of sand, coal fines, tubing irregularities, etc.

E. Flexible plungers (not shown) are flexible for coiled tubing and directional holes, and can be used as well in straight standard tubing.

Recent practices toward slim-hole wells that utilize coiled tubing also lend themselves to plunger systems. Because of the small tubing diameters, a relatively small amount of liquid may cause a well to load-up, or a relatively small amount of paraffin may plug the tubing.

Plungers use the volume of gas stored in the casing and the formation during the shut-in time to push the liquid load and plunger to the surface when the motor valve opens the well to the sales line or to the atmosphere. To operate a plunger installation, only the pressure and gas volume in the tubing/casing annulus is usually considered as the source of energy for bringing the liquid load and plunger to the surface.

The major forces acting on the cross-sectional area of the bottom of the plunger are:

- The pressure of the gas in the casing pushes up on the liquid load and the plunger.
- The sales line operating pressure and atmospheric pressure push down on the plunger.
- The weight of the liquid and the plunger weight push down on the plunger.
- Once the plunger begins moving to the surface, friction between the tubing and the liquid load acts to oppose the plunger.
- In addition, friction between the gas and tubing acts to slow the expansion of the gas.

In an ideal plunger lift application, a plunger should travel quickly to a well bottom. When a plunger falls slowly to the bottom of a well, well efficiency is not maximized. Fluid build up can hamper the plunger's descent during the return trip to the bumper spring located at the well bottom. Thus, wells with a high fluid level tend to lower well production by delaying the cycle time of the plunger system, specifically delaying the plunger return trip to the well bottom. In other words, plunger fall time can affect well production. Use of bypass plungers with bypass valves permit the fluid to flow through the plunger during the return trip to the bumper spring located at the well bottom. In an open mode, the bypass feature allows a faster plunger travel time through fluid and down the hole in high liquid wells. Bypass plungers can have a variety of orifice openings or can have a variable orifice. The bypass valve provides a shut off feature when the plunger reaches the bottom.

In certain wells, or if an operator or controllers release a plunger prematurely, a plunger could fall towards the well bottom at a relatively high velocity. As the plunger collides with the well bottom, the well seating nipple/tubing stop 12, and/or the spring standing valve/bottom hole bumper assembly 11, the impact force is absorbed in part by the plunger, the spring standing valve/bottom hole bumper assembly 11, the well seating nipple/tubing stop 12 and the well bottom (FIG. 1). A higher velocity could lead to greater impact force and can result in damage to the plunger, and/or the spring standing valve/bottom hole bumper assembly. Bumper springs could collapse over time due to repeated stress caused by impact force. Also, plunger damage can occur resulting in more frequent plunger replacement. Because some wells do not have a bumper spring at the bottom, more of the impact could be absorbed by the plunger itself. A plunger could also rise at a high velocity from the well bottom to the well top. This can occur when liquid levels are low or when an operator allows the plunger to lift prior to proper liquid loading. A high velocity rise could cause damage to the well top apparatus and to the plunger itself. Damage to well apparatus and plunger lift equipment typically increases well maintenance cost. Prior art designs have utilized plungers with externally located springs to help absorb the energy generated by the plunger force hitting the well bottom.

SUMMARY OF THE INVENTION

The present apparatus provides a plunger lift system having a bypass feature that can allow for a shorter plunger fall time. Because the increased speed of travel typically results in a greater likelihood of impact, a greater impact force, and potential damage, the present apparatus incorporates a system for absorbing the resulting shock. In addition, the rate of the plunger's speed can be adjusted though the use of either fixed or variable orifice valves.

The present apparatus provides a plunger lift system with a more reliable shock absorber. With more reliability, wells could be constructed with or without bumper spring assemblies, which typically operate to slow a plunger's travel. In well applications which do not utilize bumper spring assemblies, fewer obstructions or restrictions are encountered by a plunger at the well bottom. In these cases, plunger travel can be more optimal and plunger damage can be reduced or minimized.

By utilizing an internal placement of the shock absorbing components, plunger structure has less effect on the physical restrictions of a well bottom and any equipment housed therein. The present apparatus can be used if a reduction of well top damage (as in the case of high velocity plunger rise) and a reduction of well bottom damage (as in the case of high velocity plunger fall), is desired. In addition, the components of the present apparatus are easy to manufacture and easy to assemble.

The main aspect of the present invention is to provide an internal shock absorber bypass plunger apparatus in a high liquid well when plunger falling velocity produces a large impact force at the well bottom.

Another aspect of the present invention is to provide an internal shock absorber bypass plunger apparatus that will protect the well top apparatus and the bypass plunger when a high velocity plunger rise occurs.

Another aspect of the present invention is to provide a spring within the bypass plunger to function as the shock absorbing body.

Another aspect of the present invention is to allow for fewer restrictions on a well bottom.

Another aspect of the present invention is to provide an internal shock absorber bypass plunger that will increase reliability levels.

Another aspect of the present invention is to provide an internal shock absorber bypass plunger that will efficiently force fall inside the tubing to the well-hole bottom with increased speed without impeding plunger or well bottom damage.

Another aspect of the present invention is to provide an internal shock absorber bypass plunger that can be used with any existing plunger sidewall geometry.

Another aspect of the present invention is to provide an internal shock absorber bypass plunger apparatus that will function with either a fixed or with a variable bypass orifice(s).

Another aspect of the present invention is to allow for an internal shock absorber bypass plunger that will shut off once the plunger reaches the well bottom in order to provide for proper plunger return during lift to the well top.

Yet another aspect of the present invention is to allow for the internal shock absorber bypass plunger to have a bypass valve to be re-opened to its preset condition once the plunger reaches the well top.

Another aspect of the present invention is to allow for an internal shock absorber plunger that can be easily manufactured.

Other aspects of this invention will appear from the following description and appended claims, reference being made to the accompanying drawings forming a part of this specification wherein like reference characters designate corresponding parts in the several views.

The present invention provides efficient drop and lift in a high liquid well due to its design. The present invention comprises a bypass plunger apparatus having an internal shock absorber, whereby plunger life, as well as life of components found at a well top and a well bottom, can be extended. Although the internal shock absorber element can comprise a wave spring, a die coil spring, or an elastomer-type spring (i.e. Viton®, etc.), which can offer excellent resistance to aggressive fuels and chemicals, other shock absorbing mechanisms can be used. An actuator rod within the plunger hits the bottom of the well, shuts off the bypass function, and compresses the internal shock absorber element, which absorbs all or part of the impact shock.

The present invention comprises a plunger lift apparatus consisting of an upper mandrel, or cylindrical body, with an internal orifice allowing for liquid bypass. The upper mandrel section can comprise an internal standard American Petroleum Institute (API) fishing neck design, or other designs, and an outer wall allowing for various aforementioned sidewall geometries. Attached to the upper mandrel section is a captive actuator assembly having an internal orifice and a shock absorbing element. Attachable to the other end of the captive actuator assembly is a bypass valve (fixed or variable). When open (falling down the well), fluid flows up through the bypass valve and up through the captive actuator assembly and mandrel. If the bypass valve has a variable orifice, the plunger orifice can be set and/or adjusted to optimize the travel time to the well bottom, thus optimizing the production efficiency of the well. In addition, the well's control system can release the shock absorbing bypass plunger to fall back into the well when conditions are satisfied. Once at the well bottom, the bypass valve of the shock absorber bypass plunger shuts off when the apparatus strikes the bumper spring resulting in an absorption of all or part of the impact energy. Upon the plunger's travel to the well top, the extracting rod within the lubricator will cause the bypass valve to re-open at its predetermined set condition(s).

The present apparatus also contemplates a dual internal shock absorber plunger having two internal shock absorber elements.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF THE INVENTION

The drawings depict an internal shock absorber bypass plunger apparatus that can improve productivity levels in high liquid wells when plunger falling velocity produces a large impact force at the well bottom. The present apparatus can be used in well applications with or without a bumper spring. As stated above, high velocity lift will occur in low liquid wells, as well as instances when an operator will cycle the plunger prior to liquid loading. The present invention can also protect the plunger and the apparatus at the well top in the case of a high velocity lift.

Generally the disclosed apparatus comprises a mandrel (cylindrical body) section, a captive actuator assembly housing a shock absorbing element (shock absorbing assembly), a bypass valve assembly section having an actuator rod and functioning to open or close an inlet to an internal conduit within the plunger, thus allowing fluid to pass through the plunger when falling (open position) and not allowing fluid to pass through the plunger when rising (closed position), and wherein a falling or a rising of the plunger results in the plunger hitting a well stop causing the shock absorbing assembly to absorb a portion of an impact force created by the plunger striking the stop.

Figure 1:
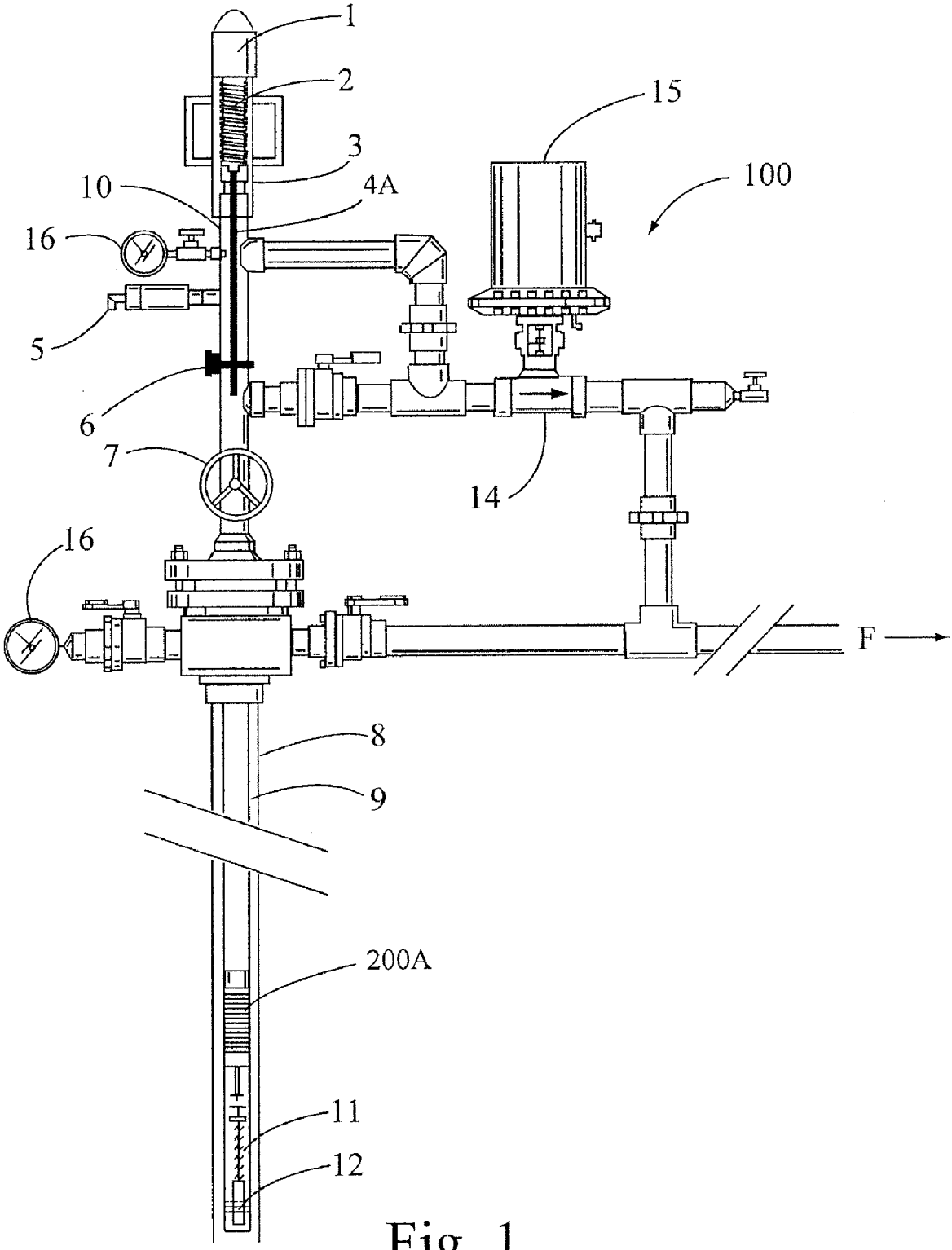
Fig. 1 (PRIOR ART)
FIG. 1 (prior art) is an overview depiction of a typical plunger lift system installation.
Figure 2:
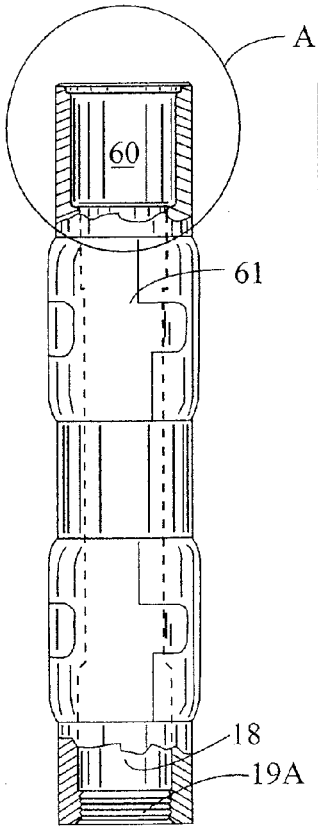
FIGS. 2-2C (prior art) are side views of mandrel sections, each having a different sidewall geometry.
Figure 2A:
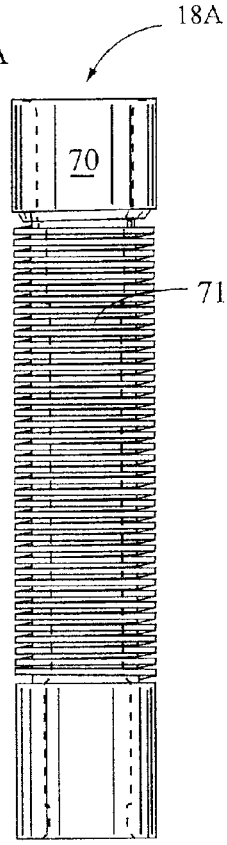
Figure 2B:
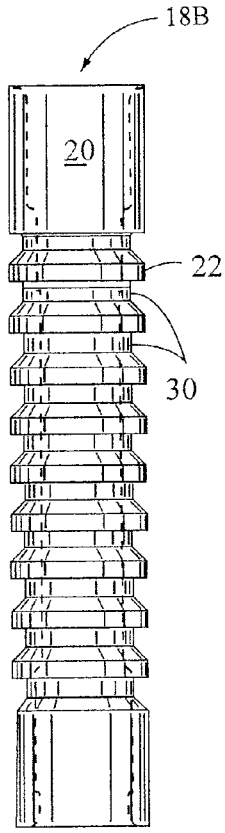
Figure 2C:
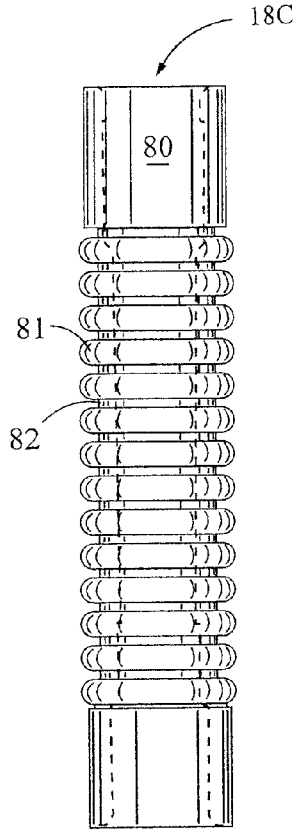
Figure 3A:
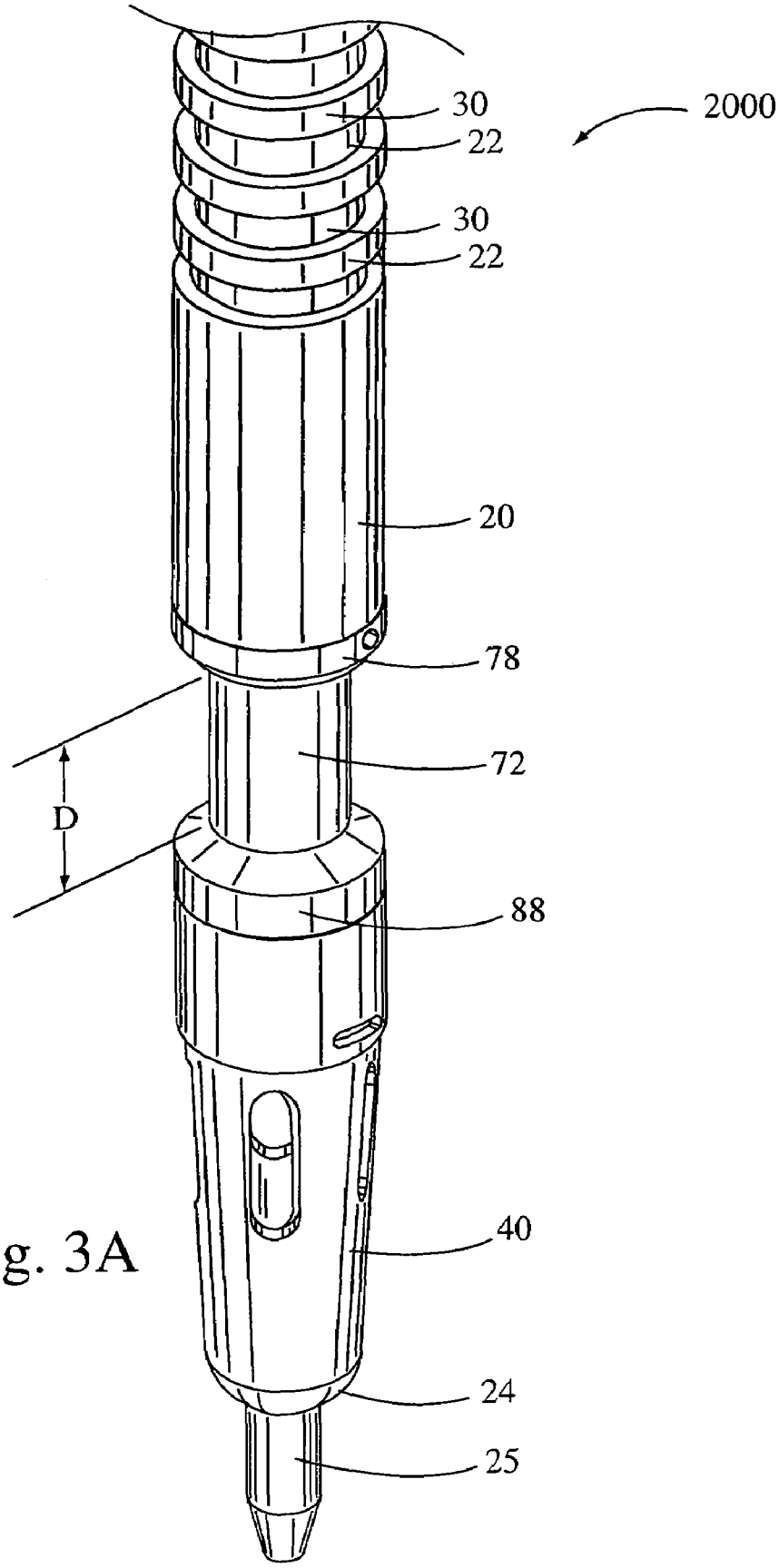
FIG. 3A is a partial isometric side view of a lower section of an internal shock absorber bypass plunger embodiment.

FIG. 3A is a partial isometric side view of the lower portion of internal shock absorber bypass plunger 2000.

Figure 3B:
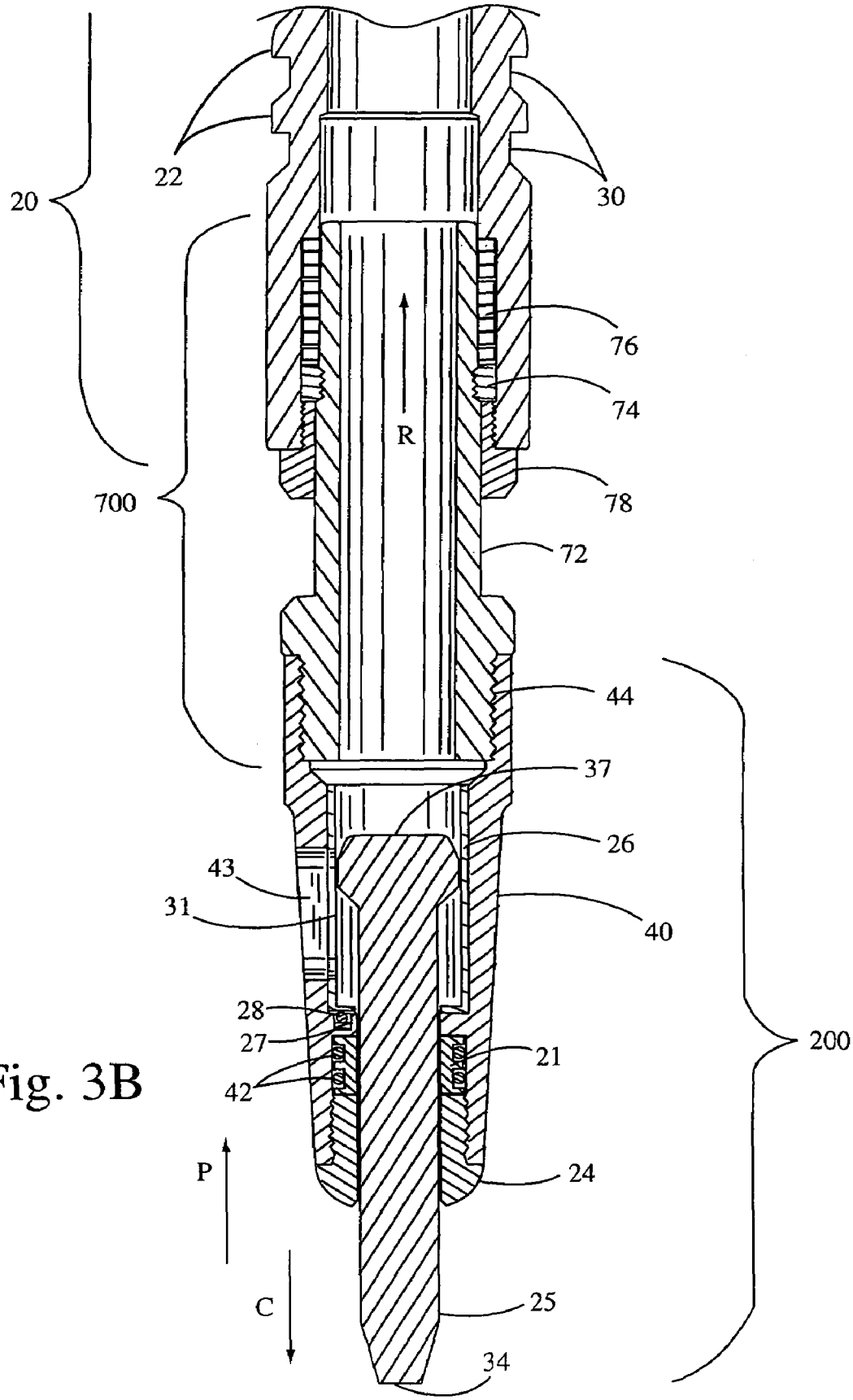
FIG. 3B is partial side cross-sectional view of the lower section of the internal shock absorber bypass plunger embodiment shown in FIG. 3A.
Figure 4:
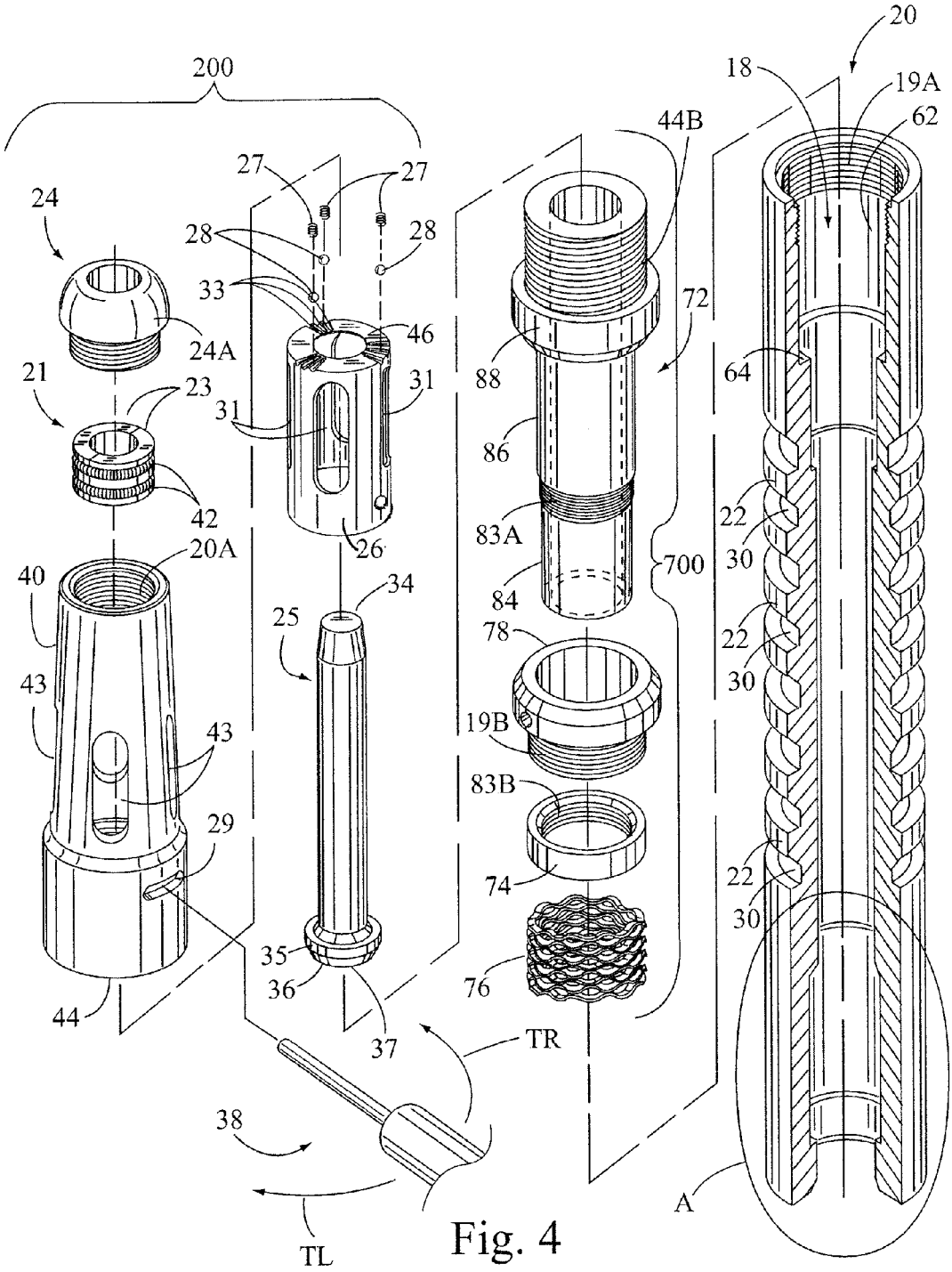
FIG. 4 is an isometric exploded view of one embodiment of the disclosed apparatus, said embodiment having a solid wall bypass mandrel, a captive actuator assembly, and a variable orifice valve (VOV) assembly.

FIG. 3B shows the embodiment in a cross-sectional view. FIG. 4 depicts the upper, central and lower portions of the disclosed apparatus in an exploded view. The embodiment shown depicts a mandrel having solid sidewall rings 22 interspaced by grooves 30.

Captive nut 78 connects captive actuator 72 to solid wall bypass mandrel 20. Although other attachment means could be used, here captive actuator 72 is threaded into variable orifice valve (VOV) casing 40 by means of threads 44 (see FIGS. 3B and 4). VOV bottom cap 24 contains actuator rod 25 within VOV casing 40. At rest, captive nut 78 is separated from captive actuator outer flange 88 by the distance D. When a force is exerted on the inner shock absorber element 76 causing it to collapse (see FIG. 3B) distance D will decrease (i.e. captive nut 78 approaches flange 88).

As shown in FIG. 4, mandrel 20 comprises internal fishing neck top A and threaded area 19 to accept captive nut 78 which holds captive actuator assembly 700. Captive actuator assembly 700 comprises captive actuator housing 72, shock absorbing element 76, lock nut 74, and captive nut 78. VOV assembly 200 comprises VOV body cylinder 40, actuator rod brake clutch 21, actuator rod 25, VOV bottom cap 24, and variable control cylinder 26.

When released from the system's auto catcher, the orifice of VOV assembly 200 will function to allow liquid to pass through the lower section of VOV assembly 200 and up through hollowed out core of assembly 700 in direction R and within the mandrel's internal conduit during the plunger's travel to the well bottom. VOV assembly 200 can be set to optimize a travel time (or fall time) for internal shock absorber bypass plunger 2000, thus optimizing the production efficiency of the well. At the well bottom, VOV assembly 200 is designed to strike a bumper spring. Actuator rod 25 will move upward in direction P and shut off the bypass feature of the apparatus. Internal shock absorber bypass plunger 2000 will absorb a portion of the impact shock. Upon its travel to the well top, the system's extracting rod 4A (which may be spring loaded) within lubricator assembly 10 will strike actuator rod 25, move it in direction C, thereby causing it to re-open at its predetermined set condition.

VOV assembly 200 comprises VOV body cylinder 40, actuator rod brake clutch 21, VOV bottom cap 24 with external threaded area 24A to mate with VOV body cylinder internal threaded lower body end 20A, actuator rod 25, and variable control cylinder 26. Body cylinder 40 comprises adjustment slot 29 for orifice adjustment access. Adjustment slot 29 provides tool 38 with access to control cylinder adjustment hole 32. In this embodiment, four VOV body cylinder orifices 43 are spaced at about 90° apart. An internal threaded lower body end 20A may accept VOV bottom cap 24. Internal wall 3 (see also FIGS. 6-7) comprises three springs 27 and three corresponding balls 28 all with a fixed position and separated by about 120°. Internal threaded upper body end 44 mates with captive actuator assembly 700.

Actuator rod brake clutch 21 comprises two half cylinders 23 each comprising annular grooves to contain annular actuator rod brake clutch springs 42. Brake clutch 21 functions to contain push rod 25 in either its open or closed position, thus allowing or stopping liquid from entering the internal conduit of the mandrel. As indicated above, VOV bottom cap 24 comprises external threaded area 24A to mate with VOV body cylinder internal threaded lower body end 20A.

Actuator rod 25 comprises bottom bumper striker end 34 functioning to move actuator rod 25 into a closed position once internal shock absorber bypass plunger 2000 hits the well bottom. Rod 25 further comprises actuator rod closure end 37 with outer closure ring 35 and rod slant surface 36 functioning to both close against actuator housing 72 in its closed position at the well bottom and also to move to an open position when shock absorber bypass plunger 2000 lifts to the well top. Extracting rod 4A within lubricator assembly 10 will strike against actuator rod 25 top end 37 to move actuator rod 25 into its open position thus engaging the bypass function and allowing liquids to flow to the internal conduit of the mandrel via the preset and adjustable orifice settings during plunger movement back to the well bottom. Variable control cylinder 26 comprises external adjustment hole 32 and four control cylinder orifices 31 which are spaced apart by about 90°. In one embodiment, variable control cylinder top surface 46 has nine position control grooves 33 located in groups of three, each group being about 120° apart and each groove within a group at being about 20° apart. Control grooves 33 mate with balls 28 three at a time within each group 120° spacing and 20° internal group hole spacing, whereby three preset through orifice positions are provided for each of the four through orifices. Thus, the VOV assembly 200 can be set at, for example, one-third open, two thirds open or full open. The total opening, or through orifice, is a function of the position of the control cylinder orifices 31 with respect to the VOV body cylinder orifices 43.

In the embodiment described, control cylinder orifices 31 align with VOV main body cylinder orifices 43 when VOV assembly 200 is assembled such that the total through orifice will be about 33%, about 67%, or about 100% depending on the positioning of variable control cylinder 26. Adjustment slot 29 provides access for external tool 38 to reach hole 32 so variable control cylinder 26 can be adjusted in direction TR or direction TL. VOV assembly 200 is geometrically designed to have a fluid/gas dynamic type shape to allow it to quickly pass to the well bottom while allowing fluids to enter its orifice and pass through the top bored out (hollowed) section of internal shock absorber bypass plunger 2000. Thus the plunger will return to the bottom with an efficient speed until it comes to rest on the bottom sitting or on a bumper spring, which will strike its actuator rod and close its bypass function.

Captive actuator assembly 700 operates as the shock absorbing assembly and mates with solid bypass mandrel 20, which is a cylindrical body. To assemble the disclosed apparatus, shock absorber element 76 can be mounted on solid bypass mandrel 20. Although a wave spring is shown, a coil spring or an elastomeric body, such as one comprising Viton®, could be used. Captive actuator 72 can be slid through captive nut 78, exposing captive actuator mid-threads 83A. Via seal nut threads 83B, seal nut (stop nut) 74 can mate with captive actuator mid-threads 83A. Captive nut 78 can be fastened to solid bypass mandrel via captive nut threads 19B and solid mandrel threads 19A. Mandrel internal sidewall 62 and internal ledge 64 will contain seal nut 74 and shock absorber element 76 with captive actuator cylindrical end sidewall 84. Captive actuator cylindrical end sidewall 84, mid-sidewall 86, and thread surface 83A with seal nut 74 attached move into shock absorber element 76 upon impact at either well end. Shock absorber element 76 can be an elastomeric body (i.e. Viton®), a wave spring, a coil spring, etc.

Figure 5A:
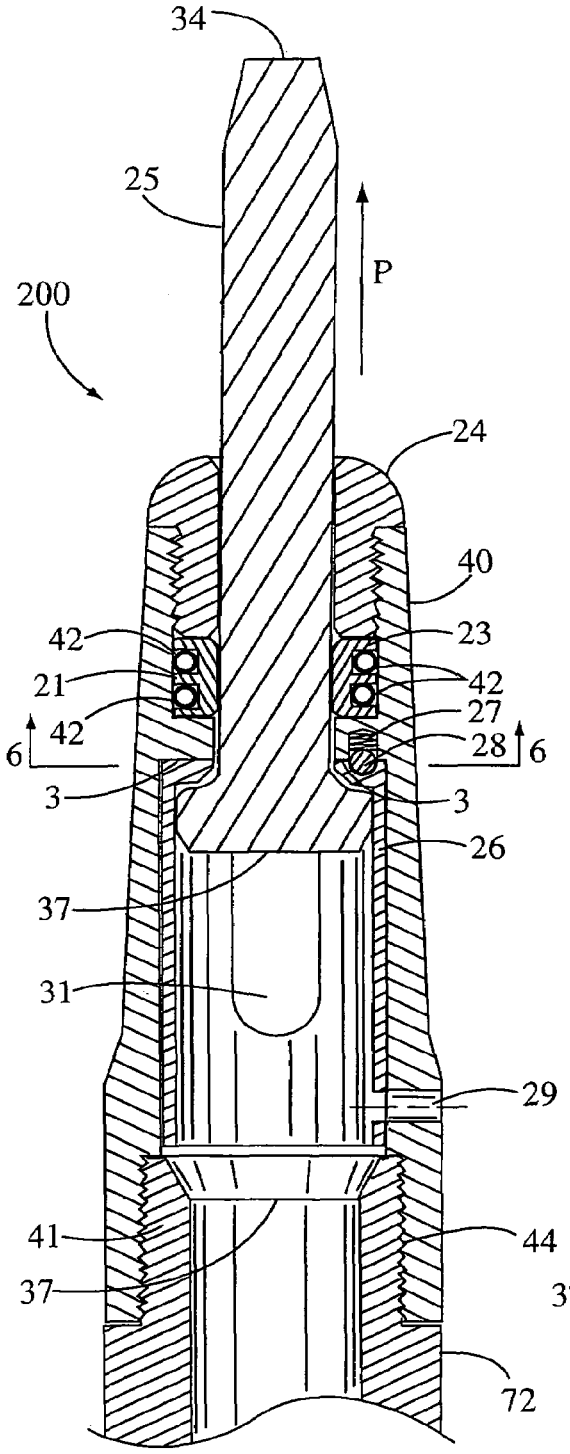
FIG. 5A is a side cross-sectional view of a VOV assembly embodiment in the open (or bypass) position.
Figure 5B:
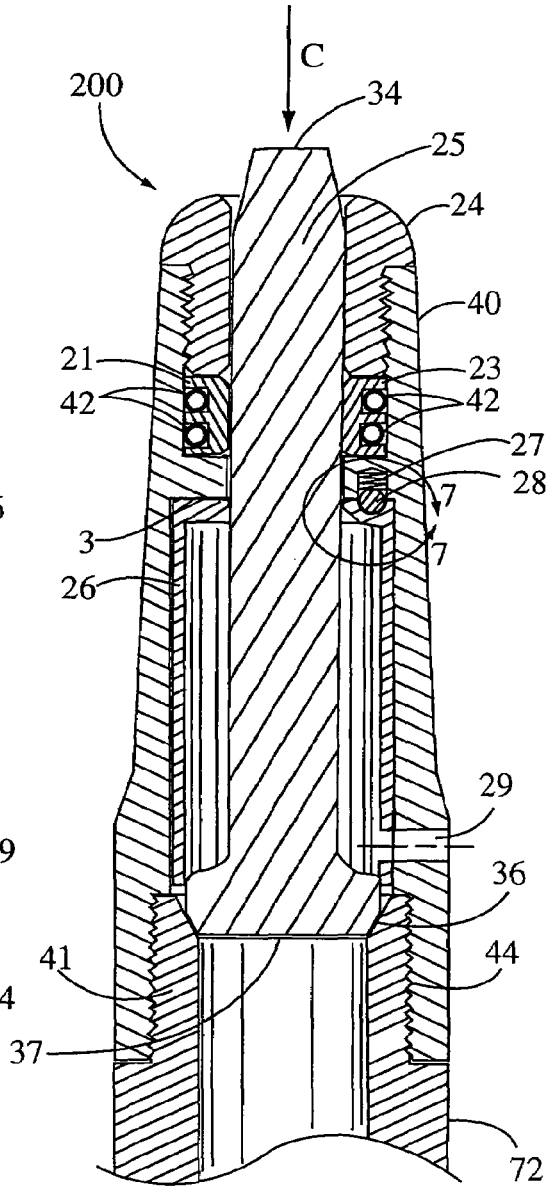
FIG. 5B is a side cross-sectional view of the VOV assembly of FIG. 5A shown in the closed (no bypass) position.

Captive actuator assembly 700 may be mounted to VOV assembly 200 by simply threading lower end threads 44B onto VOV upper end threads (not shown) at thread interface 44 (see also FIGS. 5A, 5B). Also spanner holes (not shown)

could be easily added to parts such as seal nut 34, captive nut 35, and other parts as required, to aid in fastening.

Solid wall bypass mandrel 20 interfaces with captive actuator assembly 700 at threads 19A, 19B. Solid wall bypass mandrel 20 is depicted, however other bypass mandrel geometries could also be used, including but not limited to, those described herein. Internal sidewall 62 and internal ledge 64 can contain seal nut 74 and shock absorber element 76. Internal fishing neck A can be located at a top end of solid wall bypass mandrel 20. It should be noted that although VOV assembly 200 is shown as a variable bypass valve, fixed bypass valves can also be incorporated.

FIG. 5A is a side cross-sectional view of VOV assembly 200 with actuator rod 25 shown in the open (or bypass) position. VOV assembly 200 threaded interface 44 joins VOV assembly 200 with captive actuator assembly 700. When plunger 2000 arrives at the well top, the extracting rod 4 (not shown) within the lubricator 10 hits actuator rod 25 at rod top end 37 moving actuator rod 25 in direction P to its open position. In its open position, the top end of actuator rod 25 rests against variable control cylinder 26 internal surface. Brake clutch 21 will hold actuator rod 25 in its open position allowing well loading (gas/fluids etc.) to enter the open orifice and move up through the hollowed out section of internal shock absorber bypass plunger 2000. The plunger's descent can be optimized as a function of the bypass setting.

FIG. 5B is a side cross-sectional view of the VOV assembly 200 as shown in FIG. 5A but with actuator rod 25 depicted in its closed (no bypass) position. When bottom bumper spring striker end 34 hits a bumper spring or the well bottom, actuator rod 25 moves in direction C to a closed position as shown. In the closed position, rod top end 37 with its slant surface 36 closes against threaded top section end 44. Actuator rod 25 is held in the closed position by brake clutch 21 thus allowing VOV assembly 200 to be set in a closed bypass condition and enabling the plunger to rise back to the well top.

Figure 6:
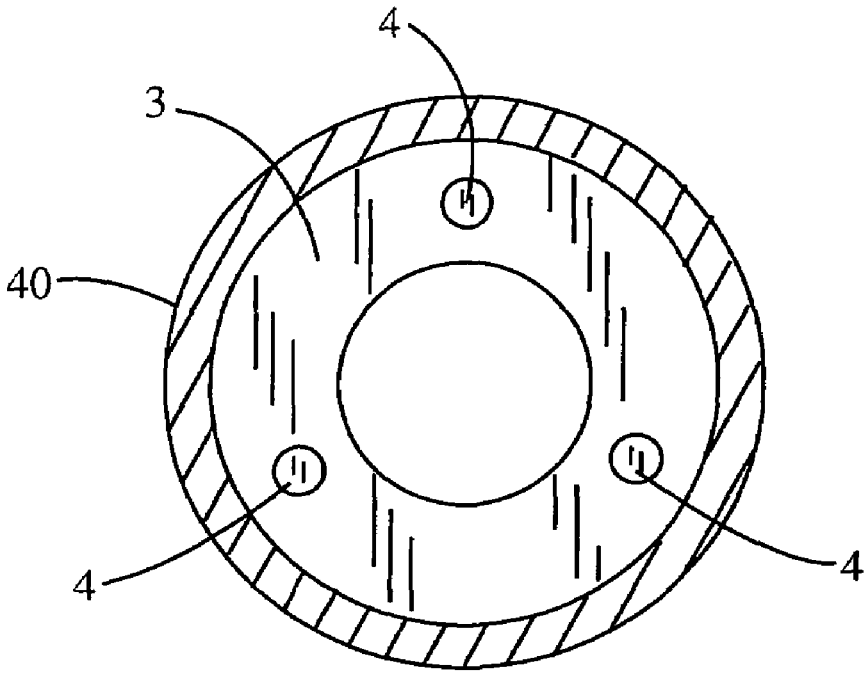
FIG. 6 is a top cross-sectional view of an inner wall internal to the VOV body cylinder as shown in FIG. 5A, showing three ball and spring fixed locations.

FIG. 6 is a cross-sectional top view taken along the line 6-6 shown in FIG. 5A. Inner wall 3 internal to VOV body cylinder 40 shows three fixed ball and spring locations. Each ball spring 27 and each ball 28 (see also FIGS. 4, 5A and 5B) are located within holes 4A which are shown in an annular position about 120° apart from one another.

Figure 7:
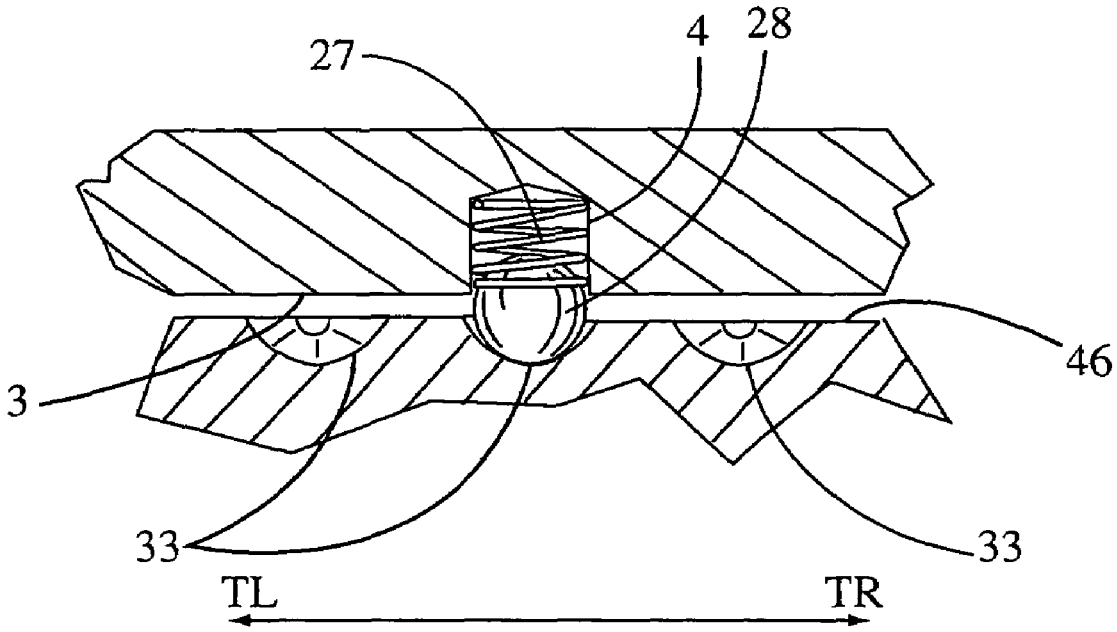
FIG. 7 is a cross-sectional view of the VOV body cylinder inner wall as shown in FIG. 5B wherein an inner variable control cylinder top surface is shown ratcheted (or set) in a mid orifice bypass set location.

FIG. 7 is a cross sectional view taken along the line 7-7 shown in FIG. 5B. VOV body cylinder inner wall 3 and the inner variable control cylinder top surface 46 are adjacent one another. Inner variable control cylinder top surface 46 is shown in the mid orifice bypass location. That is, of the possible three preset control grooves 33 shown, the through orifice is set to the mid bypass location. Ball spring 27 and ball 28 are locatable within holes 4A. In this embodiment, holes 4A have been bored into VOV body cylinder 40 such that each is fixed in its location. A variable control cylinder 26 (see also FIG. 4) can be moved indirection TR or TL. Ball spring 27 and ball 28 operate in a ratchet fashion with groove 30. Variable control cylinder 26 is ratcheted to a desired setting, thereby fixing the bypass total through orifice opening in a set location.

Figure 8A:
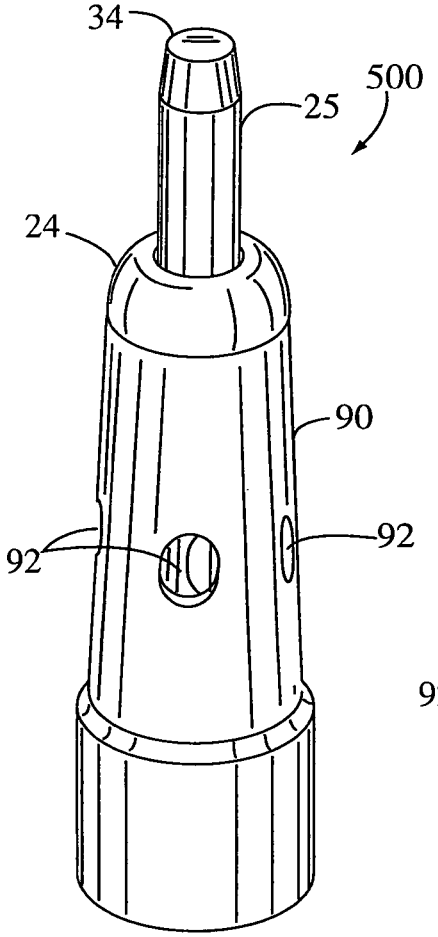
FIG. 8A is an isometric side view of a bypass valve embodiment having a fixed opening.

FIG. 8A is an isometric side view of an alternate type of bypass valve assembly. Valve assembly 500 comprises a fixed opening. Although valve assembly 500 works in the same basic manner as VOV assembly 200, its orifices are fixed. Valve assembly 500 can be used in lieu of a VOV assembly 200. As shown, the locations of bypass orifices 92 are preset. As stated below, the size of bypass orifice(s) 92 can also be preset depending on the application. If necessary, valves comprising varying but fixed orifice sizes could be used.

Figure 8B:
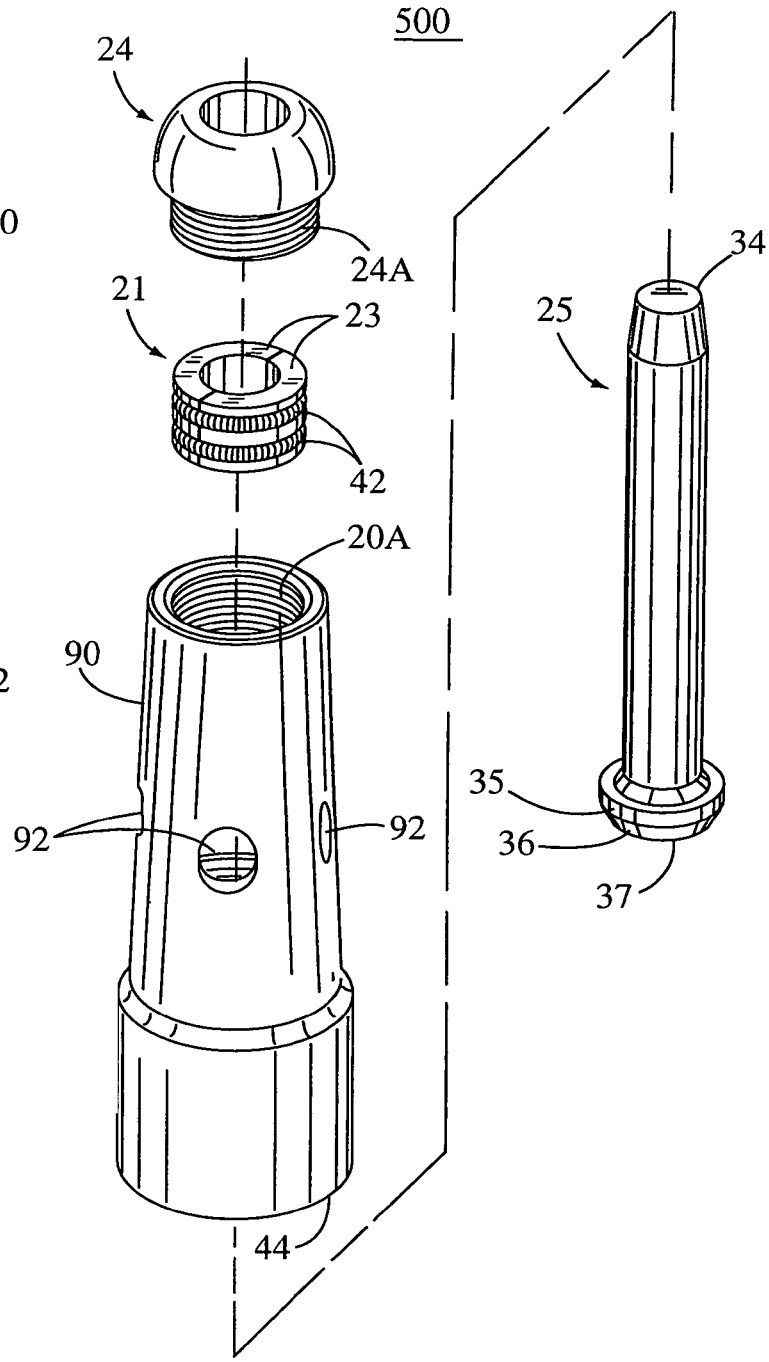
FIG. 8B is an exploded view of the bypass valve embodiment shown in FIG. 8A.

FIG. 8B is an exploded view of the bypass valve assembly 500 shown in FIG. 8A. VOV body cylinder 90 comprises bypass orifices 92. Depending on a well's requirements, a particularly sized orifice may be appropriate. Each cylinder can be manufactured such that a preset size is featured. If necessary, a bypass valve assembly 500 having smaller or larger fixed orifices could be selected to optimize well production.

All other parts can be identical to those previously described for VOV assembly 200. For example, actuator rod brake clutch 21, actuator rod 25, and VOV bottom cap 24 operate as described above. Fixed opening bypass valve 500 mounts to captive actuator assembly 700 in the same manner as VOV assembly 200.

Figure 9:
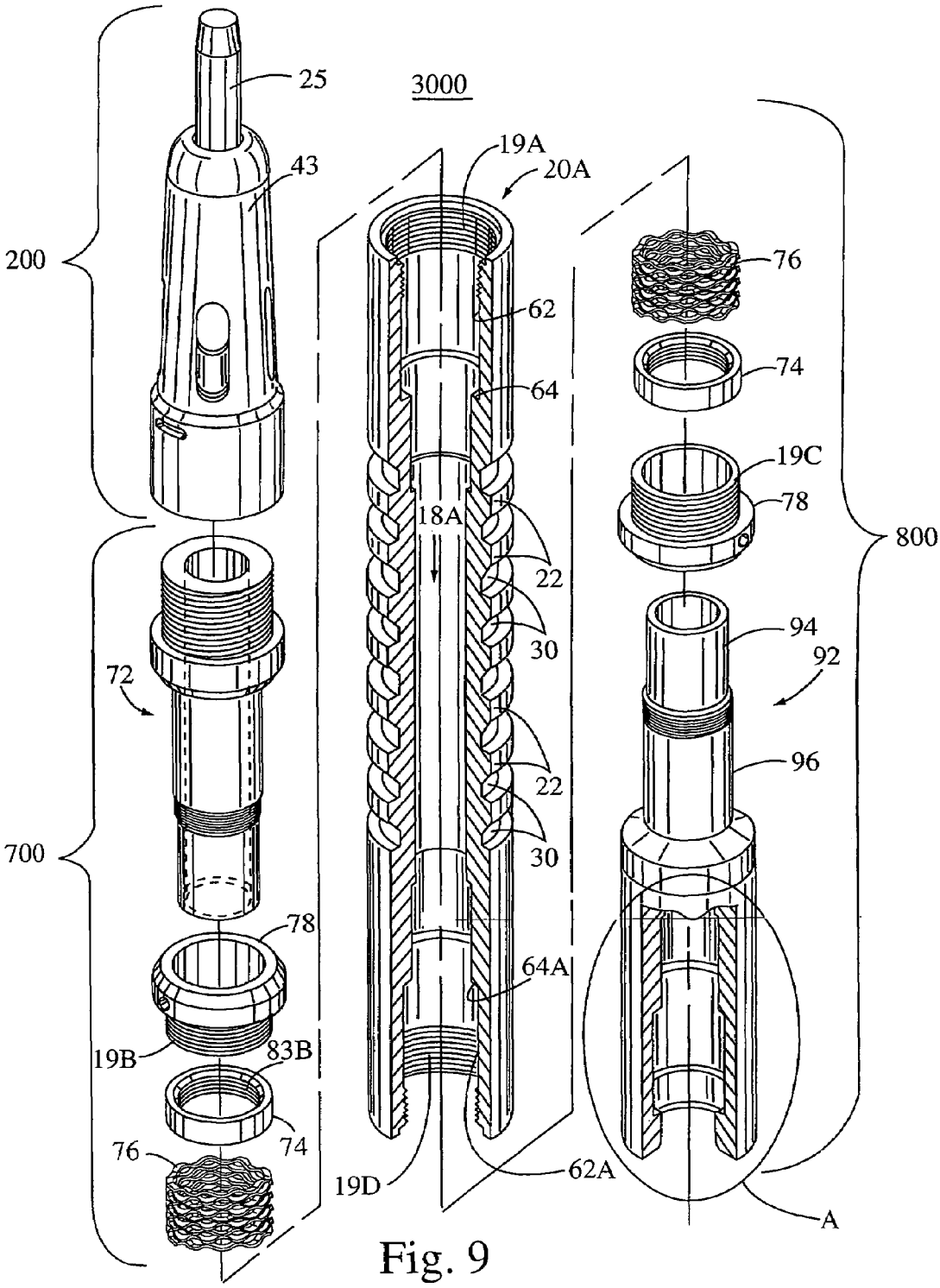
FIG. 9 is an exploded isometric view, with cut views, of an embodiment having dual shock absorber elements.

FIG. 9 is an exploded isometric view, with cut views, of an embodiment comprising dual internal shock absorber elements. Bypass plunger 3000 employs two internal shock absorber elements 76. As explained above, captive actuator assembly 700 and VOV assembly 200 mount to a mandrel section. If appropriate, a fixed opening bypass valve assembly 500 as shown in FIGS. 8A and 8B could be used. Solid wall mandrel 20A is shown in cut view to expose its internal orifice 18A, sidewalls 62, 62A and threaded ends 19A, 19D. Mandrel 20A differs from solid wall mandrel 20 (FIG. 4) in that it is symmetrical with respect to its end structures. End threads 19D can mate with an upper end 64 of captive actuator assembly 800. Internal sidewall 62A and internal ledge 64A can retain seal nut 74 and a respective shock absorber element 76.

Captive actuator assembly 800 mounts to solid wall mandrel 20A at its upper end while captive actuator assembly 700 mounts to its lower end. Upper end captive actuator assembly 800 comprises shock absorber element 76, seal nut 74, captive nut 78, and captive actuator 92. Captive nut 78 has interface threads 19C connectable to solid wall mandrel end threads 19D. In VOV assembly 200, captive nut 78 has interface threads 19B connectable to mandrel end threads 19A. Captive actuator assembly 800 also comprises captive actuator 92, captive actuator cylindrical end sidewall 94, and mid-sidewall 96. Captive actuator 92 can be designed with an internal fishing neck A at its end (shown in cut view), for retrieval purposes.

In this embodiment, a captive actuator assembly 800 mounted at the top end of the plunger and in conjunction with a captive actuator assembly 700 allows impact energy to be internally absorbed at two locations. Energy can be absorbed as a plunger's fish neck A strikes a well top. In addition, energy can be absorbed as an actuator rod 25 strikes a bumper spring in a well bottom. It should be noted that captive actuator 92, although shown as one piece, could also be manufactured as two separate parts, for example using captive actuator 72 and screwing a small separate fishing neck mandrel to its end. The internal shock absorber elements can be a wave spring as shown, a die coil spring, or an elastomer-type (i.e. Viton®, etc.) spring.

In operation, the bypass setting of the internal shock absorber bypass plunger 2000 is manually tuned for well loading conditions. If desired, the bypass setting could be fixed. As the internal shock absorber bypass plunger 2000 travels towards the bottom of a well, liquid passes through the plunger's internal core. The internal shock absorber bypass plunger 2000 falls against flow until it reaches the well bottom or a bumper spring located near the well's bottom.

As internal shock absorber bypass plunger 2000 strikes the bottom of the well or a bumper spring, the impact causes its actuator rod 25 to set in a closed bypass position. Impact energy can be absorbed by the plunger's one or more internal shock absorbers. When the well is open for flow, the plunger rises towards the well top carrying accumulated liquids out of the well bore. When the plunger hits the well top, impact energy can be absorbed by its one or more internal shock absorbers. At the well top, the lubricator catches the plunger where the extracting rod strikes actuator rod 25 to move the actuator rod into a bypass (or open) position. Typically, the well flows for a set time or condition controlled by the well-head controller before the auto catcher, as controlled by the well system controller, releases the plunger.

The plunger travels to the well bottom, its bypass opening allowing liquid to enter and flow through the plunger's core, the bypass feature helping to optimize its fall to the well bottom and thus optimizing well production efficiency. Periodically, an operator may visit the well site. Depending on well loading parameters, a bypass setting may be changed. Well conditions could warrant a resizing of the flow through orifice and/or a changing of a VOV assembly to a suitable fixed opening valve assembly. As stated above, a dual shock absorber embodiment is contemplated.

The internal shock absorber bypass plunger 2000 or internal dual shock absorber bypass plunger 3000 can allow for an initial bypass setting/tuning at the well site. In addition, future resets, if necessary, can be made. One single plunger having a bypass feature and a variety of orifice options is disclosed. The present apparatus can extend plunger and well apparatus life by absorbing impact shock and thus can help to optimize well production in high liquid gas wells.

It should be noted that although the hardware aspects of the internal shock absorber bypass plunger of the present invention have been described with reference to the exemplary embodiments above, other alternate embodiments could be easily employed by one skilled in the art to accomplish the shock absorbing and bypass aspects of the present invention. For example, it will be understood that additions, deletions, and changes may be made to the internal shock absorber bypass plunger 2000 (or internal dual shock absorber bypass plunger 3000) with respect to design, locations of internal shock absorbing elements, adjustment mechanisms to set the orifice openings (such as ratchet type adjustments etc.), various orifice opening settings or fixed positions, orifice geometric design other than those described above, and various internal part designs contained therein.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A plunger comprising:

a cylindrical body having an upper end, a lower end, and an internal longitudinal orifice;

said lower end connectable to a bypass valve assembly, the bypass valve assembly comprising a moveable actuator rod positionable in an open and a closed bypass mode, whereby a pressurized gas bypasses the internal longitudinal orifice when the actuator rod is positioned in the open bypass mode during a plunger fall;

an internal shock absorbing assembly in connection with the cylindrical body and the bypass valve assembly; and wherein a falling or a rising of the plunger results in the plunger hitting a well stop, causing the internal shock absorbing assembly to absorb a portion of an impact force created by the plunger striking the well stop.

2. The plunger of claim 1, wherein the internal shock absorbing assembly further comprises a cylinder housing connectable to the bypass valve assembly.

3. The plunger of claim 2, wherein the cylinder housing of the internal shock absorbing assembly is connectable to the cylindrical body through a captive collar.

4. The plunger of claim 1, wherein the internal shock absorbing assembly further comprises an internal shock absorbing element supportable within the cylindrical body.

5. The plunger of claim 4, wherein the internal shock absorbing element further comprises a spring.

6. The plunger of claim 4, wherein the internal shock absorbing element further comprises an elastomer.

7. The plunger of claim 1, wherein the bypass valve assembly further comprises one or more variably sized bypass orifices to receive and deliver a flow of pressurized gas from a well bottom to the internal longitudinal orifice when the actuator rod is positioned in the open bypass mode.

8. The plunger of claim 1, wherein the bypass valve assembly further comprises a clutch to hold the actuator rod in the respective open or closed positions.

9. The plunger of claim 7, wherein the bypass valve assembly further comprises a cylindrical housing having one or more variable set positions for adjusting a size of one or more bypass orifices.

10. The plunger of claim 1, wherein the upper end further comprises a connecting member connectable to an upper internal shock absorbing assembly.

11. The plunger of claim 10, wherein said upper internal shock absorbing assembly further comprises a cylinder housing connectable to said cylindrical body through a captive collar.

12. The plunger of claim 10, wherein the upper internal shock absorbing assembly further comprises an internal shock absorbing element supportable within the cylindrical body.

13. A plunger comprising:

a mandrel body having two ends;

a first of said ends having a connecting member to connect thereto a shock absorbing assembly;

said shock absorbing assembly comprising an internal shock absorbing element capable of absorbing a portion of an impact force created when a falling or a rising of the plunger results in the plunger hitting a well stop;

said internal shock absorbing element being supportable within the mandrel body; and wherein said shock absorbing assembly is connectable to a bypass valve assembly, said bypass valve assembly further comprising a moveable actuator rod positionable in an open and a closed bypass mode, whereby a pressurized gas bypasses a internal longitudinal orifice of said mandrel body when said actuator rod is positioned in the open bypass mode during a plunger fall.

14. The plunger of claim 13, wherein said shock absorbing assembly further comprises a collar to contain said internal shock absorbing element within said mandrel body.

15. The plunger of claim 13, wherein said bypass valve assembly further comprises one or more variably sized bypass orifices to receive and deliver a flow of pressurized gas from a well bottom to said internal longitudinal orifice when said actuator rod is positioned in the open bypass mode.

16. The plunger of claim 13, wherein said second of said ends further comprises a connecting member connectable to a second shock absorbing assembly.

17. The plunger of claim 16, wherein said second shock absorbing assembly further comprises a cylinder housing connectable to said mandrel body through a captive collar.

18. The plunger of claim 16, wherein said second shock absorbing assembly further comprises an internal shock absorbing element supportable within said mandrel body.

19. A plunger comprising:

a mandrel means having an internal conduit, said mandrel means functioning to pass fluids through a casing of the plunger;

an internal shock absorbing means connectable to said mandrel means and functioning to absorb a portion of an impact force created by the plunger striking a well stop; and a lower end bypass valve means connectable to the internal shock absorbing means and functioning to pass fluids through the mandrel means in an open mode, and block fluids in a closed mode.

20. A plunger comprising:

an elongate body having an upper end and a lower end;

each of said upper and lower ends comprising an internal shock absorbing assembly;

said lower end further comprising a bypass valve assembly connectable to the lower end internal shock absorbing assembly; and wherein a falling or a rising of the plunger results in the plunger hitting a well stop causing each of said internal shock absorbing assemblies to absorb a portion of an impact force created by the plunger striking the stop.

* * * * *